US005669139A

United States Patent [19]

Oldroyd et al.

[11] Patent Number: 5,669,139

[45] Date of Patent: Sep. 23, 1997

[54] RAZOR WITH BLADE PROTECTION MEANS

[75] Inventors: Brian Oldroyd; Kevin James Wain, both of Reading, England

[73] Assignee: The Gillette Company, Boston, Mass.

[21] Appl. No.: 628,394

[22] Filed: Apr. 5, 1996

Related U.S. Application Data

[63] Continuation of Ser. No. 240,755, filed as PCT/US92/10054 Nov. 20, 1992 published as WO93/10946 Jun. 10, 1993, abandoned.

[30] Foreign Application Priority Data

Nov. 27, 1991 [GB] United Kingdom ..... 9125262

[51] Int. Cl.[6] ..... B26B 21/00

[52] U.S. Cl. ..... 30/47; 30/86

[58] Field of Search ..... 30/77, 58, 47, 30/67, 50, 51, 61, 84

[56] References Cited

U.S. PATENT DOCUMENTS

| | | | |
|---|---|---|---|
| 2,125,135 | 7/1938 | Trippe | 30/58 |
| 2,426,117 | 8/1947 | Ostrovsky | 30/58 |
| 3,871,077 | 3/1975 | Nissen et al. | 30/77 |
| 3,938,247 | 2/1976 | Carbonell | 30/47 |
| 4,476,630 | 10/1984 | Byrne | 30/47 |
| 4,501,067 | 2/1985 | Duncan | 30/61 |
| 4,785,534 | 11/1988 | Lazarchik | 30/50 |
| 4,837,930 | 6/1989 | Righi | 30/47 |
| 4,860,449 | 8/1989 | Duncan | 30/47 |

FOREIGN PATENT DOCUMENTS

| | | | |
|---|---|---|---|
| 1378085 | 12/1974 | United Kingdom | 30/47 |
| 2 107 236 A | 4/1982 | United Kingdom | 30/50 |
| 2113504 A | 1/1983 | United Kingdom | B26B 21/22 |

*Primary Examiner*—Maurina T. Rachuba
*Attorney, Agent, or Firm*—Edward S. Podszus

[57] ABSTRACT

The tandem blades of a razor can be protected when not in use for shaving, without disturbing a pre-set shaving geometry and with reduced risk of damage to the blades and the fingers of a user during manipulation, by providing a shaving cartridge 11 which is movable, relative to a handle 10 of the razor, for retraction behind a shield 23 formed in the handle. Also disclosed are means to provide, in such a razor, replaceable cartridges for a permanent handle which includes a cartridge carrier 61.

13 Claims, 4 Drawing Sheets

RAZOR WITH BLADE PROTECTION MEANS

This application is a continuation of Ser. No. 8/240,755, filed as PCT/US92/10054 Nov. 20, 1992 published as WO93/10946 Jun. 10, 1993, now abandoned.

This invention relates to a razor comprising a handle, and a shaving unit which includes a cap, a guard and at least one shaving blade, the shaving unit being movable relative to the handle, between a shaving position and a non-shaving position in which the cutting edge of the or each blade is protected.

Such a razor is described in GB-A-1565415. The razor has a shaving unit mounted on a handle for pivotal movement about an axis extending parallel with the blade edge. The handle is bifurcated to provide wings which are resilient enough to provide for assembly of the shaving unit between the wings of the handle by elastic deformation of the wings and retention of the head over its range of movement.

A disadvantage of the construction, shown in GB-A-1565415, is the need for a finger or thumb of the user to manipulate the shaving unit, close to the actual blade edges, with the consequent danger of physical damage to the blade edges, or the user's hand.

GB-A-2100650 describes a razor having a guard and blade members in a fixed position on a handle of the razor and includes a cap surface, which is movable between a position in which the blade(s) are exposed for shaving and one in which the or each blade is shielded. In yet another previous proposal the cap surface is fixed but the guard-platform and blade pivot on an axis in the area of the guard surface, to carry the blade edge between a shaving position and a shielded position.

GB-A-2113594 discloses a razor having a fixed guard bar and top cap, but a blade platform which can roll between a shaving position and a retracted position, whilst GB-A-2118088 describes a razor having a fixed blade and top cap, but a pivotable guard bar, movable between a position in which the blade is exposed for shaving and a position in which the blade is protected.

A problem with all such proposals is the element of doubt and unpredictability which they introduce into the shaving geometry (that is, the relative positions of the blades, cap surface and guard surface in the shaving disposition). Even very small changes in shaving geometry can have a pronounced effect on shaving performance, and are therefore undesirable.

It is an object of the present invention to provide a razor which provides for blade protection during periods of non-use, without detriment to the shaving geometry, and with a reduced likelihood of damage to the blades or the hands of a user during manipulation of the razor.

According to one aspect of the invention, the razor initially defined is characterized in that a shielding member for shielding the or each blade is provided on said handle; the shaving unit is retractable into said non-shaving position behind said shielding member; and a retractor is provided on the handle for retracting the shaving unit behind the shielding member.

Preferably, the retracting means is manually movable in order to move the shaving unit at will between the shaving and retracted positions.

Expediently, the retracting means comprises a link between the shaving unit and the handle.

In a preferred embodiment, the shaving unit has two shaving blades, arranged in tandem. It can be arranged for the handle to be a permanent one, co-operating with replaceable shaving cartridges, the handle having a head which includes surfaces for releasably retaining one such cartridge on the head.

In one preferred embodiment the link is flexible, preferably having a distal end contiguous with the head and a proximal end attached to the body. This attachment is conveniently by a pin and slot. If the pin is on the link it may provide a surface (such as a button) on the back of the handle, that is, on the surface of the body which faces away from the surface to be shaved.

A substantial proportion of razors currently bought by consumers are of the type which allows swivelling movement between a shaving cartridge and a shaver body, during shaving, to allow the working surfaces of the cartridge to follow the contours of the skin surface being shaved. In another preferred embodiment of the present invention, the connection between the shaving unit and the body is such as to allow, in the shaving disposition, such swivelling movement.

In preferred embodiments, the link provides a tensile force which pulls the shaving cartridge into its retracted disposition, and a compressive force which pushes the head into its shaving disposition.

Preferably, translational movement between these two dispositions is accompanied by a rotational component of motion. The direction of rotational movement can be, in different embodiments, that which would increase the shaving attitude angle or reduce it.

The shaving attitude angle is the angle subtended between the longitudinal axis of the handle and a line through the skin-contacting surfaces of the cap and guard, perpendicular to the length of the cap, guard and blade surfaces.

In some embodiments the shaving unit is held to the body by the link, but in other embodiments the unit can be held onto the body by separate means, such as a pin and slot at each side of the shaving head. When the connection is through the link, it may be convenient to provide a guide channel at each side of the shaving unit for guiding the unit between the shaving and non-shaving dispositions. In embodiments in which the shaving unit is attached to the body by a pin and slot at each side of the unit, these pin and slot connections can also serve as the guide channels.

Razor cartridges and shaving units are increasingly provided with a hydrophilic lubricating strip. This needs to dry out between uses. To facilitate evaporation of water from the lubricating strip, when the cartridge is protected by the shielding member, it may be desirable to provide the shielding member with vents, such as a series of small slots. The provision of such holes in the shielding member has the incidental benefit of reducing the amount of plastics material needed to make the razor.

It is envisaged that the present invention will have general application to a wide range of disposable razors and shaving systems. For a better understanding of the present invention, and to show more clearly how the same may be carried into effect, reference will now be made, by way of example, to the accompanying drawings, in which.

Figure 1:
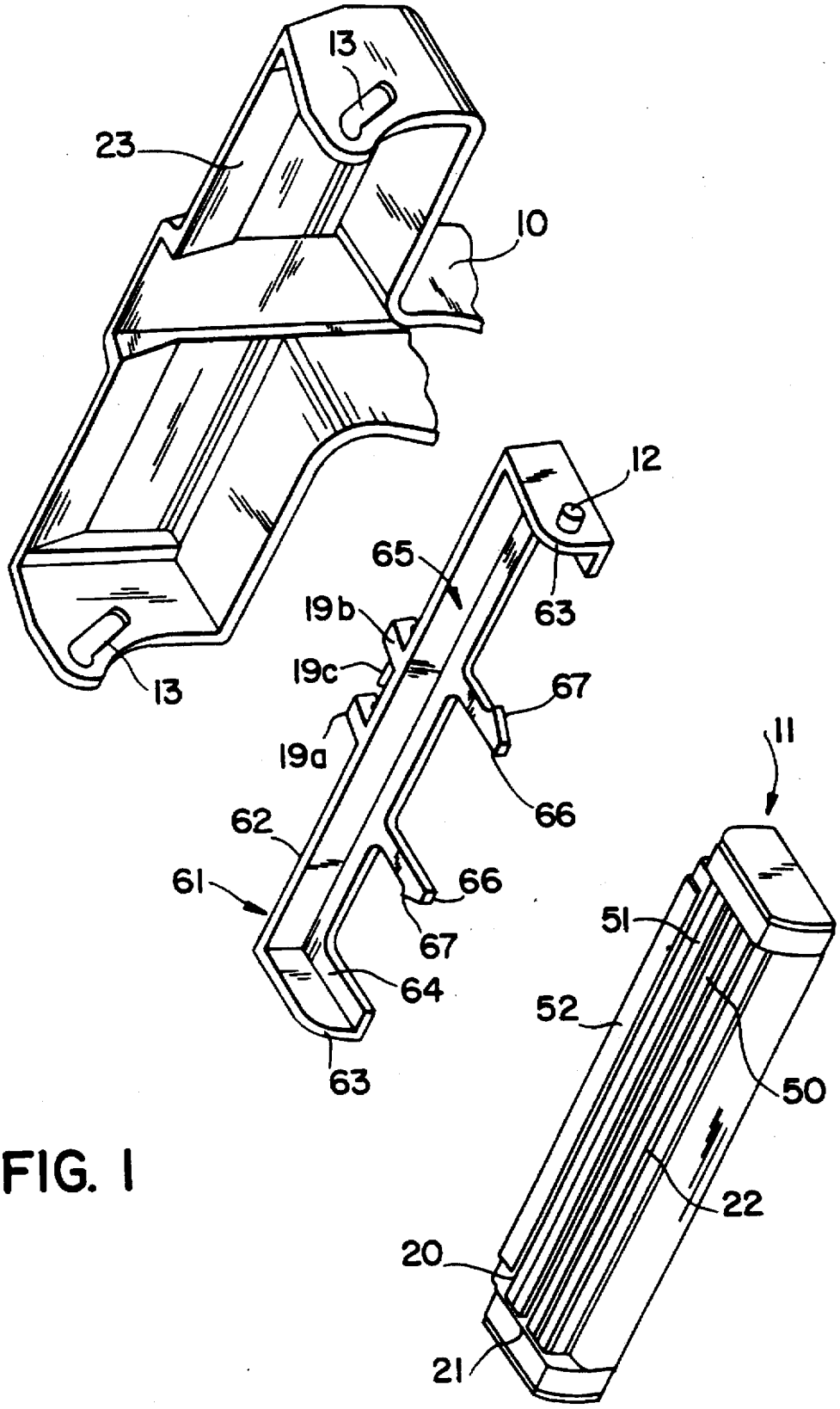
FIG. 1 is an exploded perspective view of a cartridge, cartridge carrier and head of a handle of a first embodiment of razor in accordance with the present invention.
Figure 3:
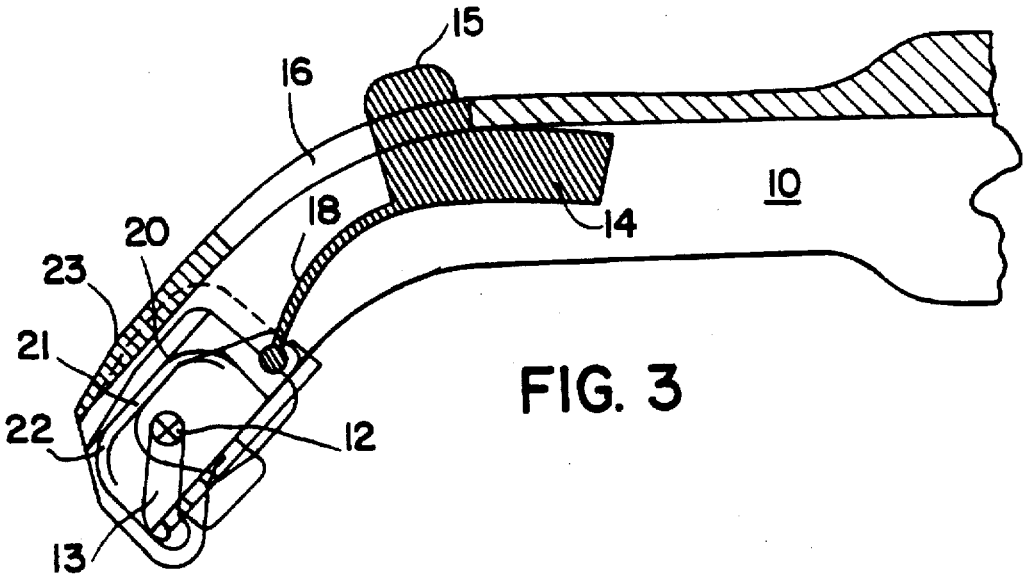
FIGS. 2 and 3 are longitudinal sections through the central axis of the head of the first embodiment, with FIG. 2 showing a shaving disposition and FIG. 3 showing a retracted disposition of the shaving cartridge.
Figure 2:
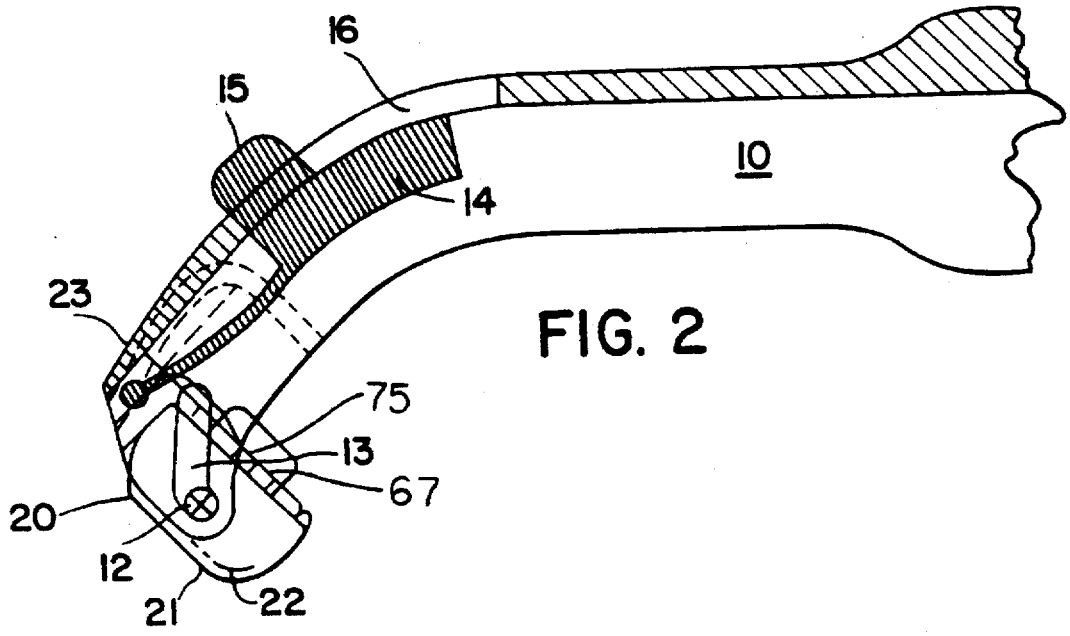

Referring first to FIGS. 1, 2 and 3, the razor comprises a handle 10 and a shaving unit in the form of a cartridge 11 at the head of the razor. The cartridge 11 comprises a cap 20, blades 50, 51 and a guard 22 and is mounted in a cartridge carrier 61 which is movably mounted in a head end of the handle 10. A lubricating strip 52 extends along one edge of the cartridge.

Each end wall 63 of the cartridge carrier 61 has a projecting pin 12 which engages in a corresponding elongate slot 13 in the head end of the handle 10. Inherent resilience of the handle 10 permits engagement of the pins 12 in their corresponding slots 13.

The carrier 61 has a long wall 62 and two end walls 63 each carrying one of the pins 12. Lugs 19*a*, 19*b*, 19*c* are provided at the mid-point of the long wall 62. A narrow shelf surface 64 extends around the base of a space 65 between the long wall 62 and the two end walls 63, the space 65 being sized to receive snugly the cartridge 11, with the cartridge sliding over the top surface of the shelf 64. A pair of resilient picker fingers 66 extends forwards from the shelf 64, each finger having a detent shoulder 67, the two shoulders both facing out from the center of the carrier 61, in opposed directions. These fingers engage with corresponding formations, on the cartridge 11, which are not visible in FIG. 1 but which are described below, with reference to FIGS. 1 to 3.

Referring to FIGS. 2 and 3, a link 14 is a snap fit in the handle 10, by the engagement of a button 15 in a slot 16 on the back surface of the handle 10. The outward-facing surface of the button 15 is provided with ridges to assist the grip of a finger or thumb of the user on the button 15 to move the link 14 between the extended disposition of FIG. 2, for shaving, and the retracted disposition shown in FIG. 3 shielded by a shield member 23.

The distal end 18 of the link 14 is a slide fit between a pair of lugs 19*a*, 19*b*, and a third, opposed, lug 19*c*, all of which are on the long wall 62 of the cartridge carrier 61 adjacent to the cap 20 of any cartridge carried by the carrier 61. Each cartridge has a pair of lugs 75 one to engage with each of the detent shoulders 67. FIG. 2 shows the pin 12 in the distal end of the slot 13, so that the blades 50, 51 of the cartridge 11, between the guard 22 and the cap 20, are presented at the correct attitude for comfortable shaving.

With the button 15 moved to the proximal position shown in FIG. 3, it can be seen that a tension force applied by the link 14 has pulled the cartridge 11 into a more proximal position, demonstrated by the position of the pin 12 at the proximal end of the slot 13. The cap 20 and shaving blades 50, 51 have been drawn up inside the handle, to be protected by the shield member 23. A simple reverse movement of the button 15, back to its distal position, is sufficient to place the cartridge back in its shaving disposition as shown in FIG. 2.

The movement of the pins 12 along the slots 13 corresponds to the translational movement of the cartridge between the shaving and non-shaving (retracted) dispositions. Comparison of FIGS. 2 and 3 shows that this translation accompanies a rotational movement which places the shaving surface of the cartridge adjacent to the protecting shield member 23.

The above-described first embodiment is of a shaving system, with a succession of replaceable cartridges being used in the same razor handle. In a variant, a cartridge can be connected direct to the link, thereby providing a razor in which the handle and cartridge are disposable together.

Figure 4:
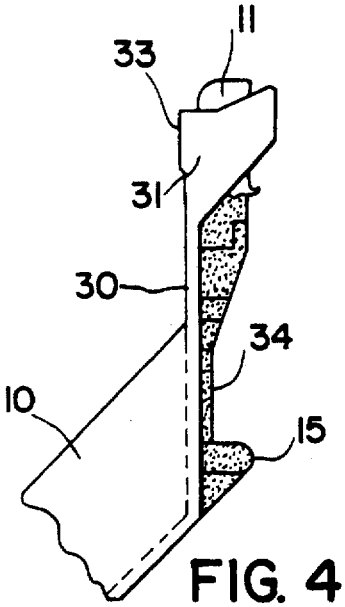
FIGS. 4 and 5 are a side view and top plan view respectively of a second embodiment of razor, with a retractable cartridge in its retracted position.
Figure 5:
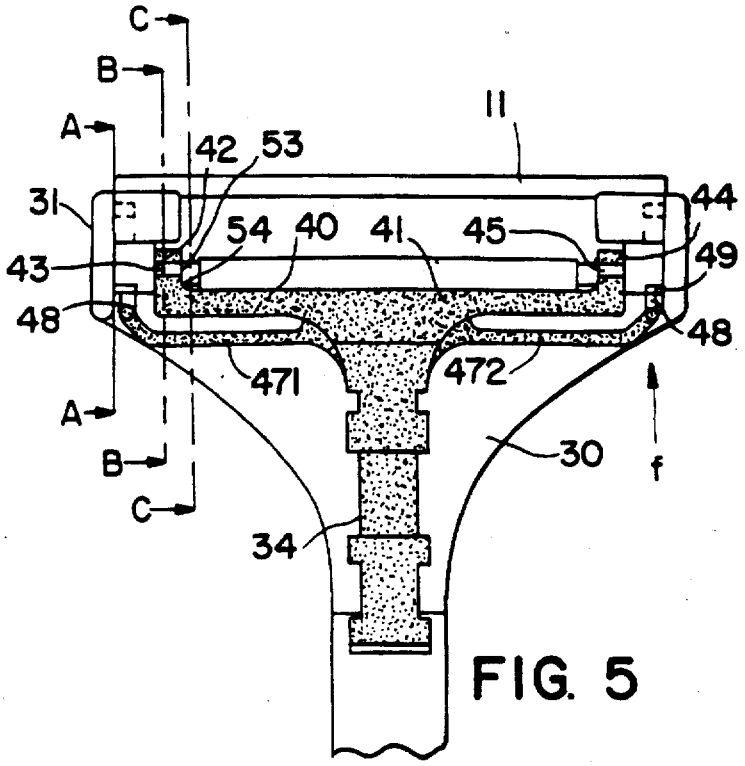
Figure 6:
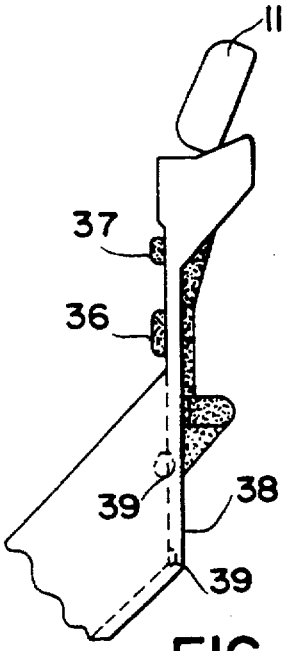
FIGS. 6 and 7 are a side view and a top plan view of the razor of FIGS. 4 and 5 in the extended position.
Figure 7:
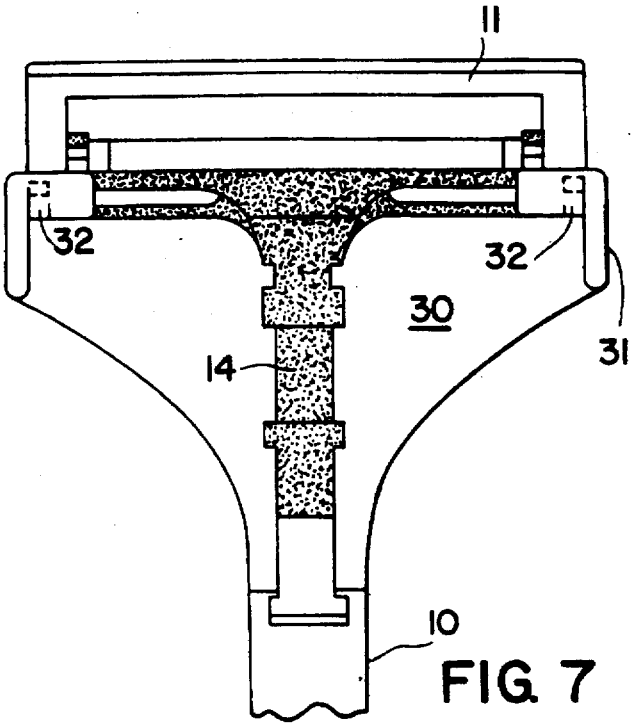

FIGS. 4 to 16 show the construction and operation of the second illustrated embodiment, and much of this is the same as for the first embodiment, so that identical reference numerals are used whenever possible. The handle 10 has a stem which widens at its head into a plate 30 which has upturned ends 31 which form a guide channel 32 for each side of the cartridge 11. FIGS. 4 and 5 show the cartridge 11 fully accommodated within the guide channels 32, with the shaving blades 21 of the cartridge 11 closely protected by a shielding wall 33 of the plate 30 of the handle 10.

The link 14 has a proximal end in the form of a strip 34 which slides in a corresponding slot within the plate 30 of the handle. As with FIG. 2, there is a button 15 on the top surface of the plate 30, for manual manipulation of the link to move between its distal and proximal positions but, unlike FIG. 2, the strip 34 lies on the outside of the handle. The link includes first and second saddle pieces 36, 37 which run in the slot and retain the strip 34 on the plate 30. Latching surfaces 39 and a degree of resilience are provided so that the strip latches to the handle at each extreme of its movement, but unlatches upon application of pressure and movement to the button 15.

The link 14 is bifurcated at its distal end to form left and right arms 40, 41 which extend respectively to the left and right sides of the cartridge 11. On the distal end of the arm 40 is a claw 42 (best shown in FIG. 9) which engages with a latch surface 43 of the cartridge for rotary movement of the cartridge on the claw 42 at the surface 43. A shell bearing surface 53 on the cartridge co-operates with a bearing surface 54 on the arm 40 (see FIG. 10). There are corresponding claw 44 and latch 45 surfaces, and bearing surfaces, at the distal end of the right arm 41, and the cartridge is retained to the link 14 by the co-operation of these respective surfaces.

Figure 8:
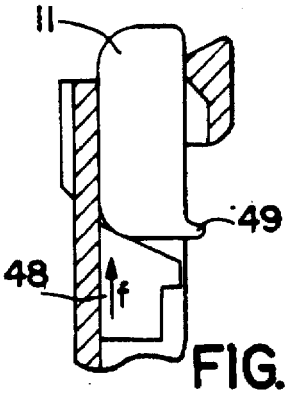
FIGS. 8, 9 and 10 are sections A—A, B—B, C—C respectively, taken from FIG. 5.
Figure 9:
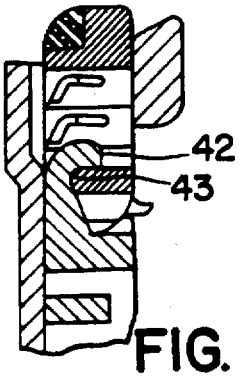
Figure 10:
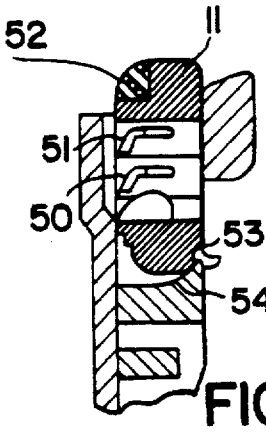
Figure 11:
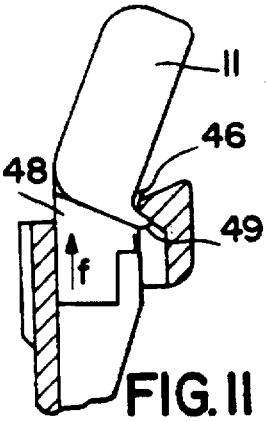
FIGS. 11, 12 and 13 are corresponding sections from FIG. 7.
Figure 12:
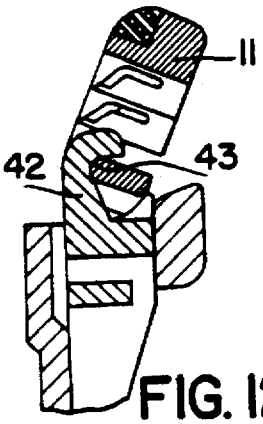
Figure 13:
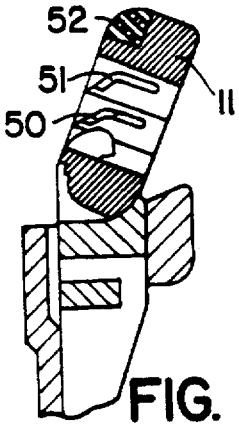
Figure 14:
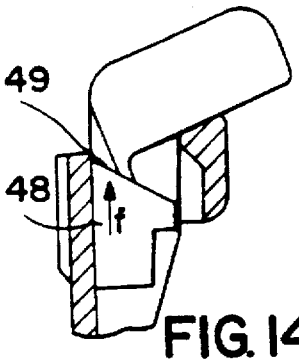
FIGS. 14, 15 and 16 are sections corresponding to those of FIGS. 11 to 13 but with the shaving cartridge pushed, against a spring bias, into a swivelled shaving disposition.
Figure 15:
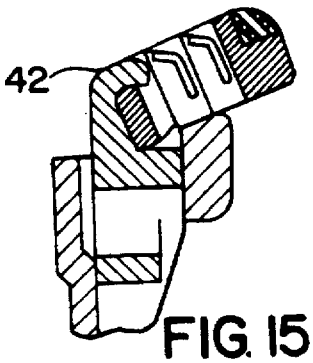
Figure 16:
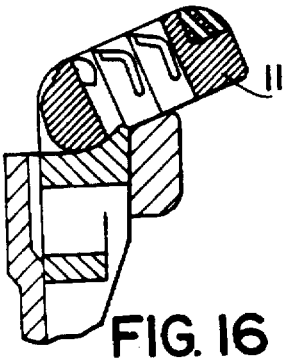

As illustrated in FIGS. 8, 11 and 14, a hook 46 at the left hand side of the cartridge 11 engages with an internal surface of the channel end 31 of the handle 10 to rotate the cartridge to the initial shaving disposition during movement of the button 15 from the proximal to the distal end of the slot 16. A corresponding hook (not shown) is present at the other end of the cartridge, and co-operates in the same way with the handle.

Referring to FIG. 5 the link 14 also has a pair of leaf springs, that is, a left hand spring 471 which extends along the back of the arm 40 and a right hand spring 472 which extends along the back of the arm 41. Each spring has at its outer end a pressure pad 48 which is pressed by the resilience of the leaf on to a camming surface 49 of the cartridge 11, in the direction of arrow f. Thus, rotation of the cartridge from the FIG. 11 starting shaving position (also called the extended position) to the FIG. 14 deflected position (also called the swivelled shaving position) drives the springs back and increases the biasing force on the cartridge 11 tending to return it to the FIG. 11 starting shaving position as soon as it is permitted to do so. (Thus, during shaving, the springs provide a return force on the cartridge 11 which acts to bias the cartridge 11 to its shaving position whenever it is deflected from that position.

The tandem blades 50, 51 of the cartridge are visible in the sections along B—B and C—C. As is known per se, these blades can be mounted resiliently, to be deflected by the skin surface being shaved, as shaving pressures vary in use of the razor. The cartridge may incorporate a hydrophilic lubricating strip 52, as is also known per se.

With the described razors, the cartridge includes all of the cap surface, guard surface and blade(s). Because the whole cartridge moves between the shaving and retracted positions, there is accordingly no relative movement between the components of the cartridge during this cartridge movement.

The simplicity of design of the illustrated embodiments open up possibilities for using a wide range of cartridge designs including those with spring-loaded tandem blades. The embodiments also provide a good basis for designs which use replaceable shaving cartridges with a permanent handle. It will be appreciated that manipulation of the button 15 can be done repeatedly without any danger of accidental contact damage to the shaving blade edges, because the button 15 is so far from the edges and is on the backface of the handle.

Retraction of the shaving head into the handle brings about a reduction in physical size of the razor which is another attractive feature of the device when it is not in use.

We claim:

1. A razor comprising a handle, a shaving unit which includes a skin-engaging cap, a guard and at least one shaving blade, wherein a position of said skin engaging cap, said guard and said at least one shaving blade determines a shaving geometry, and means for moving the shaving unit relative to the handle between a shaving position and a non-shaving position in which the cutting edge of the at least one blade is protected, wherein said handle further comprises a shielding member non-removably formed with said handle for shielding the at least one blade, the shaving unit is retractable into said non-shaving position behind said shielding member, and retracting means are provided on the handle for retracting the shaving unit behind the shielding member.

2. A razor as claimed in claim 1, wherein the retracting means comprises a link between the shaving unit and the handle.

3. A razor as claimed in claim 2, wherein the link is flexible.

4. A razor as claimed in claim 2, wherein the link is connected to the handle by a pin and slot connection.

5. A razor as claimed in claim 4, wherein the pin is on the link and provides an operating button.

6. A razor as claimed in claim 1, wherein the shaving unit comprises a cartridge carrier and a replaceable cartridge carried by the carrier.

7. A razor as claimed in claim 6, wherein the cartridge carrier and the replaceable cartridge each have at least one co-operating latching surface for retaining the cartridge in the carrier.

8. A razor as claimed in claim 7, wherein the carrier latch surface is a shoulder on a resilient spring finger and the cartridge latch surface is a lug.

9. A razor as claimed in claim 7, and including means to inhibit co-operation of the latching surfaces if the handle is positioned closely adjacent to the cartridge in an opposite orientation from a useful orientation.

10. A razor as claimed in claim 1, wherein the shaving unit in a shaving disposition is carried on the handle for swivelling movement between a starting shaving position and deflected shaving positions.

11. A razor as claimed in claim 1, wherein the shaving unit has camming surfaces, and wherein the handle has leaf springs which act against the camming surfaces to urge the shaving unit into a starting shaving position.

12. A razor as claimed in claim 11, wherein the shaving unit is held by claw surfaces captive in the handle, for rotation on the handle, between the retracted position, a starting shaving position and a range of deflected shaving positions.

13. A razor as claimed in claim 1, wherein the shaving unit is retained to the handle by a pair of pin and slot connections which also define the locus of movement of the cartridge unit between the shaving and retracted positions.

* * * * *

UNITED STATES PATENT AND TRADEMARK OFFICE

CERTIFICATE OF CORRECTION

PATENT NO. : 5,669,139

DATED : September 23, 1997

INVENTOR(S) : Brian Oldroyd

It is certified that error appears in the above-indentified patent and that said Letters Patent is hereby corrected as shown below:

--claim 11 depends from claim 10.--

--claim 12 depends from claim 10.--

Signed and Sealed this

Eighteenth Day of November 1997

*Attest:*

Bruce Lehman

BRUCE LEHMAN

*Attesting Officer*

*Commissioner of Patents and Trademarks*